US010265632B2

(12) United States Patent
Soriani

(10) Patent No.: US 10,265,632 B2
(45) Date of Patent: Apr. 23, 2019

(54) AMUSEMENT DEVICE WITH TILTING ROTATABLE STRUCTURE

(71) Applicant: ANTONIO ZAMPERLA S.p.A., Altavilla Vicentina (IT)

(72) Inventor: Claudio Soriani, Melara (IT)

(73) Assignee: ANTONIO ZAMPERLA S.p.A., Altavilla, Vicentina (IT)

( * ) Notice: Subject to any disclaimer, the term of this patent is extended or adjusted under 35 U.S.C. 154(b) by 0 days.

(21) Appl. No.: 15/524,687

(22) PCT Filed: Nov. 12, 2015

(86) PCT No.: PCT/EP2015/076417
§ 371 (c)(1),
(2) Date: May 5, 2017

(87) PCT Pub. No.: WO2016/079000
PCT Pub. Date: May 26, 2016

(65) Prior Publication Data

US 2018/0304161 A1 Oct. 25, 2018

(30) Foreign Application Priority Data

Nov. 17, 2014 (EP) ..... 14193551

(51) Int. Cl.
*A63G 1/28* (2006.01)
*A63G 27/02* (2006.01)
(Continued)

(52) U.S. Cl.
CPC ..... *A63G 27/04* (2013.01); *A63G 1/28* (2013.01); *A63G 1/44* (2013.01); *A63G 27/02* (2013.01); *A63G 2200/00* (2013.01)

(58) Field of Classification Search
CPC ... A63G 1/00; A63G 1/10; A63G 1/28; A63G 1/38; A63G 1/40; A63G 4/00; A63G 27/04
(Continued)

(56) References Cited

U.S. PATENT DOCUMENTS 3,787,046 A * 1/1974 Clem ..... A63G 1/28 472/3
3,905,596 A * 9/1975 Barber ..... A63G 1/10 187/206
(Continued)

FOREIGN PATENT DOCUMENTS

CN 101559285 10/2009
DE 1980612 3/1968
(Continued)

OTHER PUBLICATIONS

European Search Report of priority EP application 14193551.0 dated Apr. 21, 2015.
(Continued)

*Primary Examiner* — Kien Nguyen
(74) *Attorney, Agent, or Firm* — Silvia Salvadori

(57) ABSTRACT

Amusement device comprising a base structure (2), an arm (3) constrained at least rotationally to said base structure (2), a rotating structure (4) provided with at least one vehicle (8) and rotatably constrained, with respect to one end of said arm, around a rotation axis (R), and movement means (6) for moving the arm between at least a first load position in which passengers are loaded, and a second rotation position of the rotating structure (4). The arm comprises at least two portions (31, 32) mutually movable, and in the load position, the arm portions are completely comprised in a cylinder (C)
(Continued)

having an axis that is said rotation axis (R), and having a radius that is the distance from the vehicle to the rotation axis.

13 Claims, 10 Drawing Sheets

(51) Int. Cl.
*A63G 27/04* (2006.01)
*A63G 1/44* (2006.01)

(58) Field of Classification Search
USPC ..... 472/31–35, 45–47
See application file for complete search history.

(56) References Cited

U.S. PATENT DOCUMENTS 4,007,926 A * 2/1977 Ottaway ..... A63G 4/00 472/1
5,688,178 A * 11/1997 Emrie ..... A63G 1/38 438/654
5,791,998 A * 8/1998 Moser ..... A63G 27/04 472/31
7,744,476 B2 * 6/2010 Knijpstra ..... A63G 27/04 472/1

FOREIGN PATENT DOCUMENTS

| | | |
|---|---|---|
| DE | 1288494 | 1/1969 |
| EP | 0283872 | 9/1988 |
| GB | 1342650 | 1/1974 |
| WO | 2006052132 | 5/2006 |

OTHER PUBLICATIONS

International Search report of PCT/EP2015/076417 dated Feb. 24, 2016.
IPRP of PCT/EP2015/076417 dated May 23, 2017.

* cited by examiner

AMUSEMENT DEVICE WITH TILTING ROTATABLE STRUCTURE

RELATED APPLICATIONS

This application is the US national phase application of international application number PCT/EP2015/076417, filed 12 Nov. 2015, which designates the US and claims priority to European application EP 14193551.0 filed 17 Nov. 2014, the contents of each of which are hereby incorporated by reference as if set forth in their entireties.

FIELD OF THE INVENTION

The present invention concerns an amusement device with a tiltable rotating structure. More particularly, the invention concerns an amusement device of the type in which an arm has a rotating structure provided with a plurality of passenger vehicles.

PRIOR ART

A number of amusement devices of this type are known in the art. Amusement devices known as "ferris wheel" have one or more fixed arms bearing the wheels with vehicles, in general gondolas that can house more than one passenger. In these amusement devices, passengers enter and go out of vehicles when the wheel move the latter next to a load/unload position, usually in the lowest part of the wheel. Because passengers use this entry/going out method, the rotation speed of the amusement device and the passenger payload per hour are necessarily reduced.

To solve this problem amusement devices have been suggested, in which the rotating structure is mounted on an arm acting also as a lifter to be able to carry the rotating structure from a (almost) horizontal position near the ground, to a tilted or substantially vertical, raised position. In the raised position, the rotating structure can be rotated at relatively high speeds.

EP0283872 describes an amusement device of the above described type and comprises a base structure rested on the ground, an arm hinged with respect to said base structure and a rotating structure provided with passenger vehicle mounted at the free end of the arm. The arm is raised to move the rotating structure to the work position, i.e. in a position tilted of about 45° with respect to the ground.

GB 1342650 describes an amusement device provided with two arms about 90° from one another; each arm is provided with vehicles mounted on substructures rotatable with respect to the base rotating structure. The arms are moved alternately from a horizontal position, in which passengers are loaded and unloaded, to a substantially vertical position in which the structures are all rotated with a planetary motion.

Amusement devices named Enterprise are further known and available on the market, as can be found in Wikipedia and they are made and marketed, for example, by HUSS, Schwarzkopf, and Heinz Fähtz companies. Such amusement devices comprise a hydraulic arm on which a wheel provided with vehicles is mounted, the wheel being moved by the arm to a substantially horizontal initial position to an angled or substantially vertical position in which it rotates.

Vehicles are mounted in a swinging manner on the perimeter of the rotating structure: in this way, at the beginning, they can be perpendicular to the ground (when passengers are getting in/out), and then they are moved to a tilted position due to the centrifugal force caused by a quick rotation of the rotating structure carrying the vehicles. In the horizontal position, that is in the rest position or in the passenger load/unload position, the hydraulic arm is under the rotating structure; the hydraulic arm, when raised, is placed side-by-side the rotating structure that carries the vehicles.

A problem for these amusement devices are costs of the equipment and its implementation, the latter needing works to house the base the arm is constrained to. As a matter of fact, a part of the arm comes out from below the rotating structure and extends up to a bearing base, on which it releases forces when the amusement device is operative. Furthermore, the presence of an arm protruding from the structure is not so much pleasing to the eye and usually needs additional camouflage works, which are on the other hand expensive and not so much effective.

Object of the present invention is to solve the above mentioned problems and to provide an amusement device of Enterprise type as defined above, which is inexpensive to be manufactured and implemented and aesthetically attractive, without losing advantages coming from quickness in getting in/out the passengers.

These and other objects are achieved through the present invention by an amusement device provided with features according to claim 1.

Preferred aspects of the amusement device are set forth in the independent claims.

In particular, according to an aspect of the present invention, an amusement device comprises a base structure, an arm constrained at least rotationally to the base structure, and a rotating structure provided with at least one vehicle. The rotating structure is rotatably constrained with respect to one end of the arm, around a rotation axis. The amusement device further comprises movement means for moving the arm between at least a first load position in which passengers are loaded, and at least a second rotation position of the rotating structure. In particular, the arm comprises two or more portions mutually movable, and at least in the load position, the arm portions are completely comprised within a cylinder having an axis that is the rotation axis of the rotating structure, and having a radius that is the distance from the at least one vehicle to the rotation axis.

Due to the present invention, advantageously the machine has reduced bulks and allows a better management of the ground of the amusement parks in which the machine is hosted, in particular allowing a higher number of attractions to be arranged in the park.

Moreover, as the arm moving the rotating structure is, in the load position, contained in the bulk of the rotating structure itself, housing structures for the base to which the arm is constrained are not necessarily implemented. Furthermore, a platform is not necessarily installed around the amusement device, thereby allowing remarkable simplicity, inexpensiveness and quickness of amusement device installation, in addition to the mentioned space savings. The aesthetic aspect of the amusement device is consequently improved.

In order to increase the above mentioned advantages, in the load position also the base structure is preferably completely comprised in the mentioned cylinder.

According to an aspect of the present invention, the arm portions are mutually rotatable. Such an arrangement allows to fold the arm simply, so that its whole bulk can be decreased. As discussed in detail hereinafter, the arm is extended and the parts thereof are mutually rotated during the extending (and folding) step. There are several hinging points of the arm parts; consequently, there is not only one point of rotation around which the arm parts rotate.

According to an aspect of the present invention, a portion of said arm comprises at least one four-bar linkage. Such a structure is manufactured easily, and it allows an accurate control of the relative rotation among the arm portions. According to a further aspect of the present invention, the four-bar linkage comprises two cranks hinged to the base structure, and a connecting rod hinged in three different points, respectively to the first crank, the second crank and a second portion of the arm.

Through such an arrangement a simple control of the relative position of arm portions is obtained, and in particular it allows rotating easily the arm portions also in initial and ending steps of the arm movement, i.e. when the angles among such portions are close to zero and ninety degrees.

According to an aspect of the present invention, the movement means are constrained to the arm portion constrained, in its turn, to the rotating structure.

Such a solution allows an effective distribution of loads between the arm portions, and allows, in a simple manner, carrying out an accurate adjustment of the relative position between the mentioned portions.

According to another aspect of the present invention, the base structure comprises a constraining portion, comprising two constraining points of the cranks, placed at different heights from one another. The constraining portion is part of the four-bar linkage and fixed to the base structure.

According to a preferred aspect of the present invention, the arm has two mutually movable portions; nevertheless implementations with more than two arm portions are possible.

In the preferred embodiment there is only one second arm portion, mounted on the four-bar linkage and having the means for the connection with the rotating structure at its free end. Preferably, at least one constraining element, not being part of said four-bar linkage, connects the first arm portion to the second arm portion so that an arm with only one degree of freedom is obtained.

Preferably, the movement means, i.e. hydraulic pistons or different raising means, are constrained to the second arm portion constrained, in its turn, to the rotating structure. Thanks to this, the arm has only one degree of freedom, i.e. the relative angle between two portions of the arm itself. The arm can then be moved by only one movement means, for example a couple of pistons or actuators.

According to an aspect of the present invention, the rotating structure has a concave section. In particular, as the arm has a little bulk, some curvature can be provided for the rotating structure, or anyway the rotating structure can be implemented by mutually angle portions. In other terms, when the amusement device is in the folded position near the ground, the distance from the ground of the perimeter of the rotating structure, to which the constraints are constrained, is smaller than the distance from the ground of the central part of the structure.

Thanks to this, when the rotating structure is in the load position, vehicles can be moved closer to the ground, i.e. vehicles are preferably placed substantially flush with the base structure. Such an arrangement allows a user to get in and out from the vehicle easily.

BRIEF DESCRIPTION OF THE FIGURES

Referring to the attached figures, an exemplary and not limitative embodiment of the present invention is now introduced, in which.

MODES FOR IMPLEMENTING THE INVENTION

Figure 1:
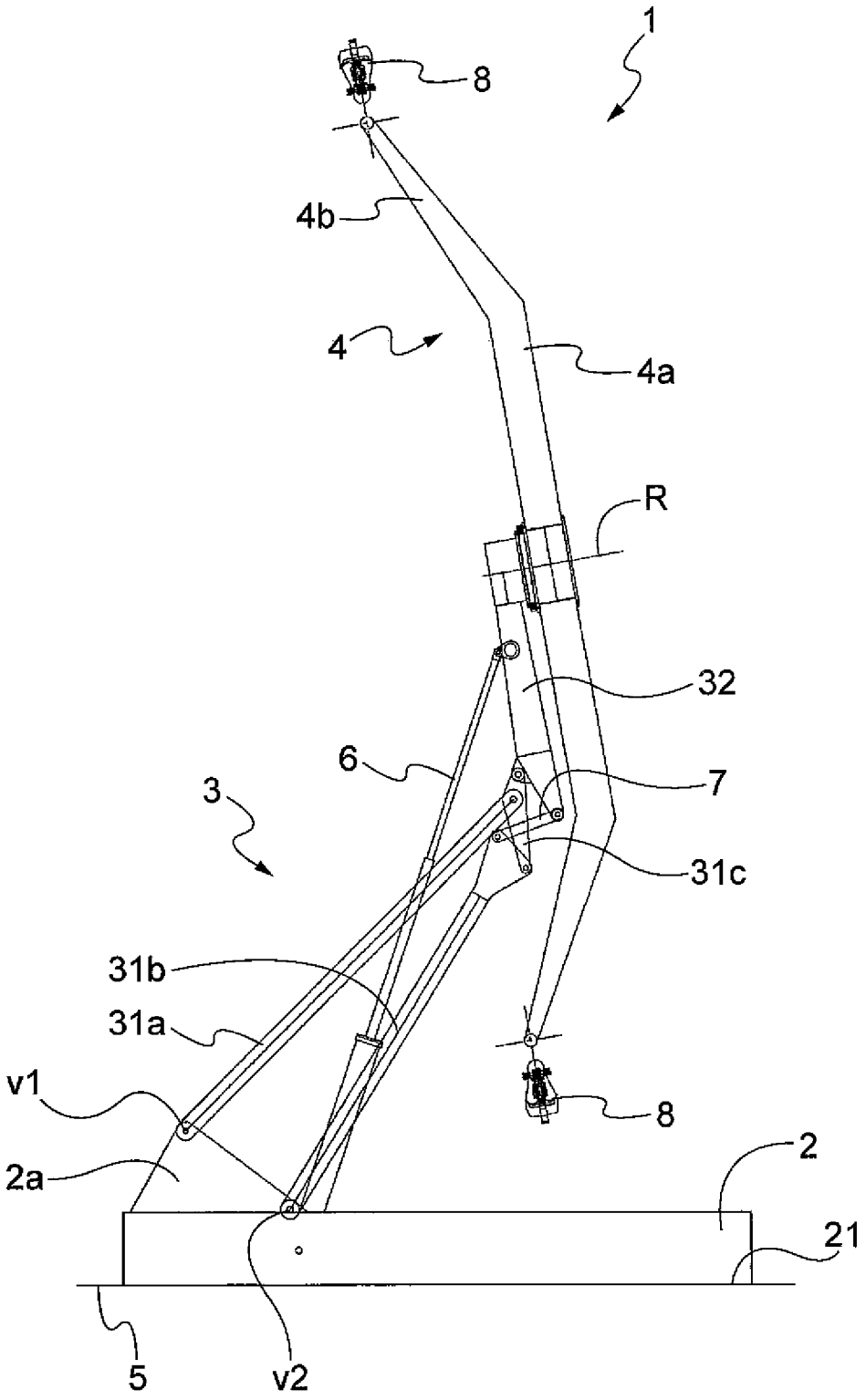
FIG. 1 is a side view of an amusement device according to the present invention.

Referring to the attached figures, an amusement device 1 according to the present invention comprises a base structure 2, an arm 3 and a rotating structure 4.

The arm 3 has two or more mutually movable portions 31, 32.

The rotating structure 4 is provided with one or more vehicles 8 for one or more passengers. The rotating structure 4 is further rotatably constrained to the arm 3 around a rotation axis R.

Figure 8:
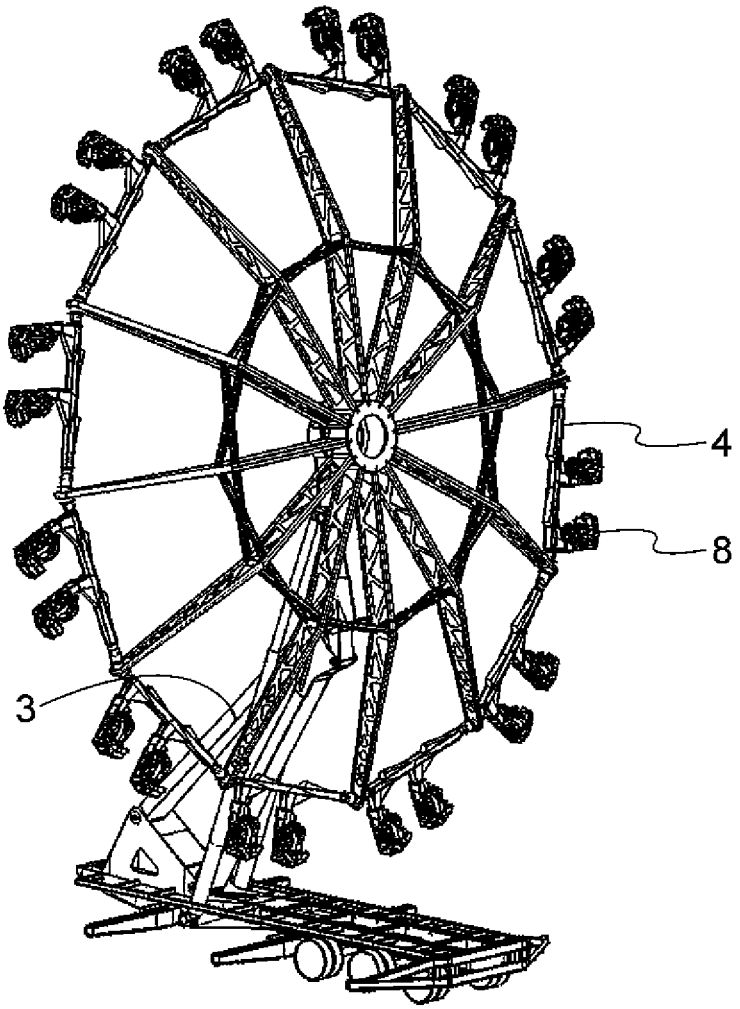

Movement means 6 are constrained to the arm 3 and thereby move the rotating structure 4 between at least one passenger load position (shown in FIG. 6), and a second rotation position of the structure (shown in FIG. 8).

Preferably, in the load position, the rotation axis R is substantially perpendicular to the ground 5, or anyway to the surface on which the base structure 2 rests.

Furthermore, in the load position, preferably passengers can get in all vehicles 8 of the amusement device 1. In other words, in the load position, all vehicles 8 of the amusement device 1 are arranged so that to allow a passenger to be loaded.

Preferably, in the rotation position, the rotation axis R of the rotating structure R is substantially parallel, or incident with a little angle usually smaller than 20 degrees, with respect to the ground 5 or the surface on which the base structure 2 rests.

In general, the rotation axis R, between the two mentioned positions, is rotated with respect to the ground 5.

The base structure 2 provides a stable support for the amusement device 1, and it rests generically to a bearing surface, typically it rests to the ground 5.

Figure 2:
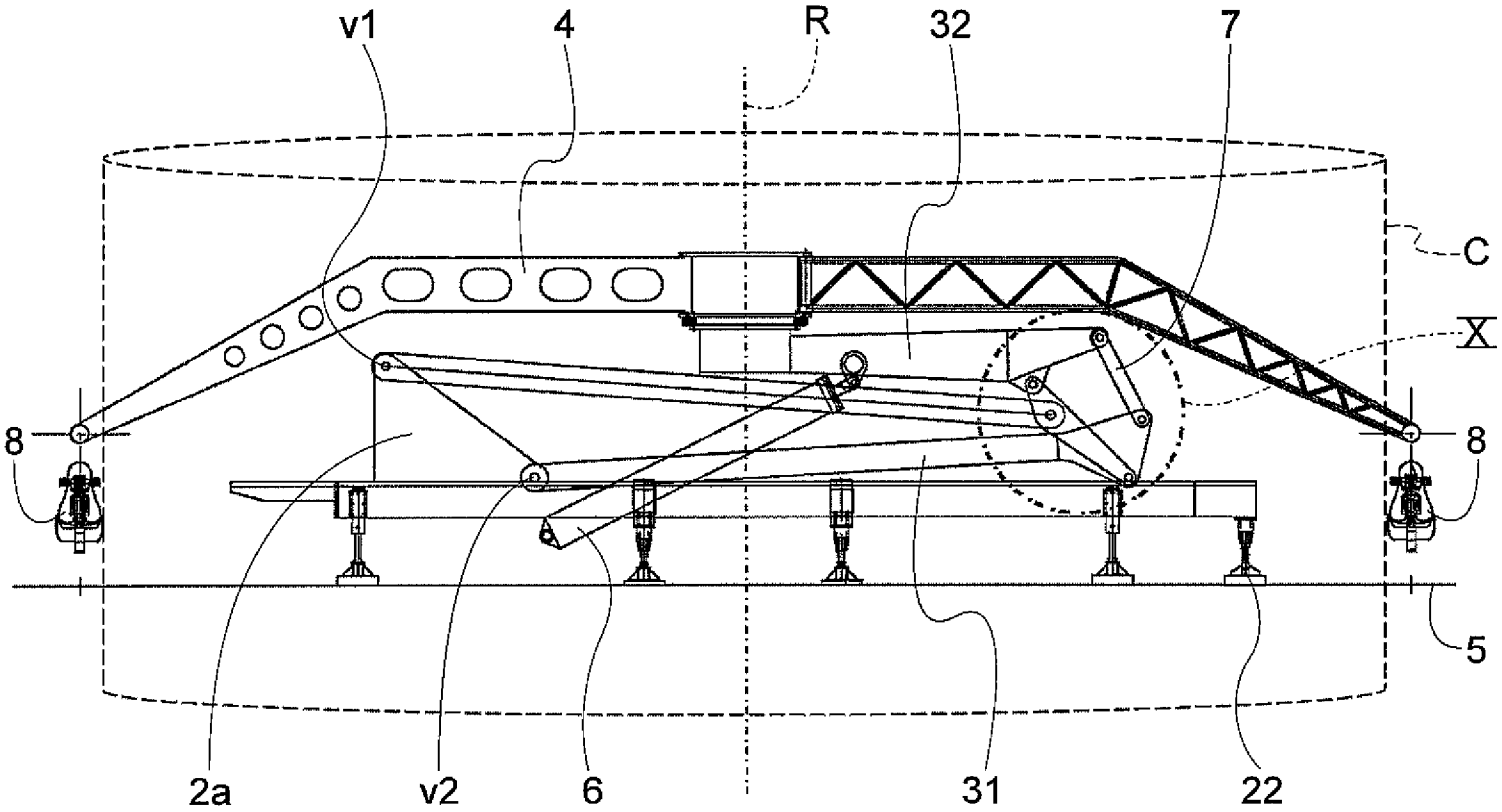
FIG. 2 is a front view of an amusement device according to the present invention.

Such a bearing can be implemented according to different configurations. In FIG. 1, for example, the base structure has a bearing surface 21 on the ground 5. In FIG. 2, according to an alternative embodiment, the base structure 2 has bearing feet 22 on the ground 5. In FIGS. 3-8, the base structure has bearing wheels 23 on the ground, which allow the base structure 2 to be moved, if necessary. Appropriate means, not shown, lock the bearing wheels 23. Alternatively, bearing feet can be used to raise the base structure 2 from the ground 5 to a height greater than the diameter of the bearing wheels 23.

In general, as mentioned, the base structure provides the amusement device 1 with a bearing to the ground 5 or to a similar surface.

Preferably, the base structure 2 comprises a constraining portion 2*a* to which a portion 31 of the arm 3 is constrained. As better explained in the following, in an embodiment of the present invention, the constraining portion 2*a* protrudes from the base structure 2 and, in case in which the portion 31 of the arm 3 is constituted by several elements 31*a*, 31*b*, 31*c*, it provides constraining points v1, v2 for at least for part of these elements 31*a*, 31*b* placed at heights mutually different from the ground 5.

The arm 3 is hinged to the base structure 2 so that to be able to at least rotate relative to the latter.

According to an aspect of the present invention, the rotating structure 4 is constrained to the base structure 2 only by means of the arm 3. In other terms, the arm 3 is the only element connecting the rotating structure 4 to the base structure 2 and, preferably, there are no more devices supporting the wheel or the arm, apart from the movement means for moving the arm.

As mentioned, the arm 3 has at least two mutually movable portions 31, 32. The portions 31, 32, in particular when moving the rotating structure 4 to the passenger load position, are completely comprised in a cylinder C having infinite height, shown in FIG. 2 in a dotted line, whose axis is the rotation axis R of the rotating structure 4 and whose radius is the distance between the axis R and the vehicle 8. The "distance" between the axis R and the vehicle 8 means the "minimum distance", i.e. the distance from the axis R to the point of the vehicle 8 closest to the axis R itself.

In other words, there is at least one cylinder C with infinite height and having the axis R as its own axis, whereby the arm 3 is completely comprised inside such a cylinder, whereas the vehicle 8 is completely outside such a cylinder.

In the load position, the arm 3 is then preferably completely arranged under the rotating structure 4, i.e. it does not protrude nor laterally neither above the latter.

The plant bulk of the rotating structure 4, when it is in the passenger load position, is greater than the plant bulk of the arm 3 and, particularly, the bulk of the arm 3 is completely enclosed in the bulk of the rotating structure 4.

Preferably, also the base structure 2 meets such a condition. In other words, when the rotating structure 4 is in the load position, both the base structure 2 and the arm 3 (i.e. the portion 31, 32 of the arm 3) are completely comprised in a cylinder C having infinite height and whose axis is the rotation axis R of the rotating structure 4 and whose radius is the distance from the axis R to the vehicle 8.

The relative movement among the portions 31, 32 of the arm 3 allows maintaining the arm 3 inside the cylinder C. In particular, referring to figures, an embodiment in which the portions 31, 32 of the arm 3 are mutually rotatable is now discussed. In any case embodiments in which the portions of the arm 3 are mutually translate are not excluded (for example, telescopically), or else contemporaneously rotatable and translatable.

Referring to figures, the preferred described implementation provides for an arm 3 constituted by two portions 31, 32. In alternative embodiments, not shown, the arm is composed of a greater number of mutually movable portions.

A first arm portion 31 preferably comprises a four-bar linkage 31*a*, 31*b*, 31*c*. A second portion 32 is preferably made as a single piece, or anyway a plurality of pieces rigidly constrained one to another. However, embodiments in which several portions (possibly all of them) are made with single pieces (or a plurality of rigidly constrained pieces) are possible, as well as embodiments in which several portions (or all of them) have a four-bar linkage.

Turning back to the embodiment shown in figures, the first portion 31 has a four-bar linkage 31*a*, 31*b*, 31*c*, and in particular it comprises two cranks 31*a*, 31*b* and a connecting rod 31*c*. The cranks 31*a*, 31*b* are constrained to different points of the base structure. In particular, in the present embodiment, the cranks 31*a*, 31*b* are hinged to the constraining portion 2*a* in two constraining points v1, v2 placed at distances mutually different from the ground.

Figure 9:
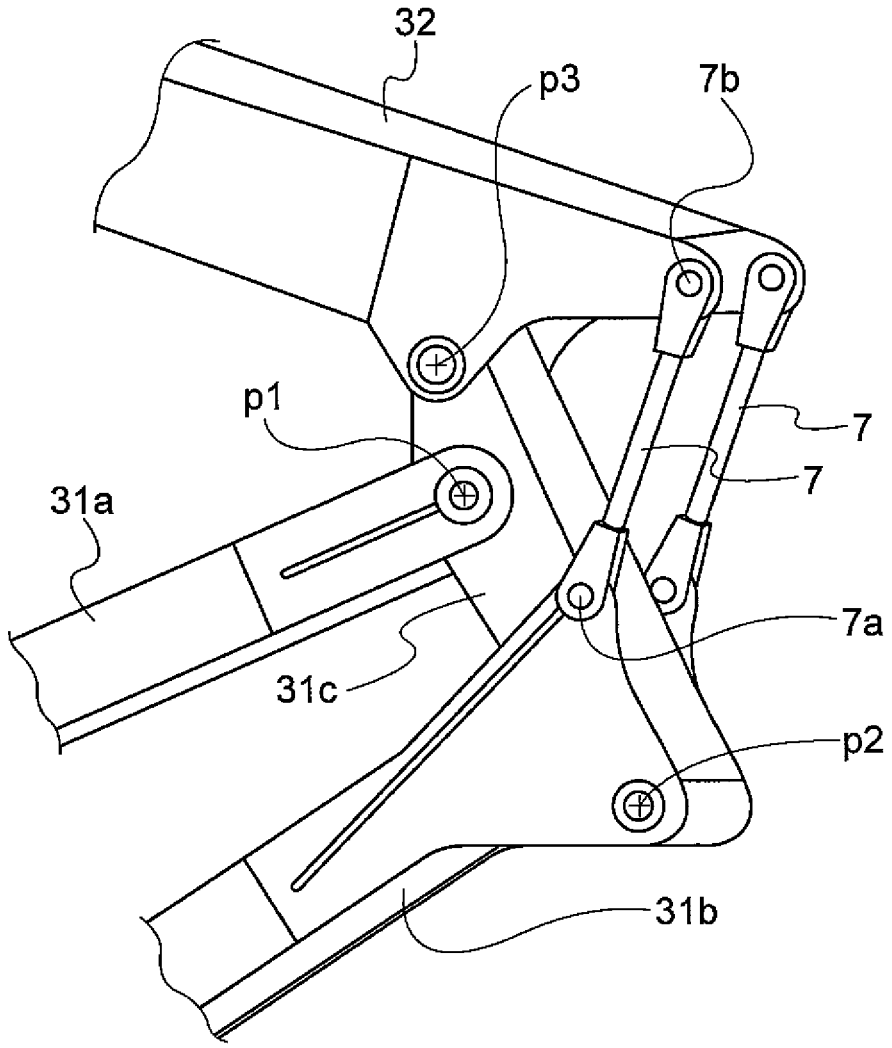
FIG. 9 is a magnified view of the magnified detail IX of FIG. 4.

A connecting rod 31*c* is hinged, in constraining points p1, p2 (FIG. 9) different from one another, to two cranks 31*a*, 31*b*. In particular, the connecting rod 31*c* is hinged in the constraining point p1 to the crank 31*a*, and in a different constraining point p2 to the crank 31*b*. The connecting rod 31*c* is further constrained, in a third constraining point p3 different from the constraining point p1, p2 of the connecting rod 31*c* with the cranks 31*a*, 31*b*, to the second portion 32 of the arm 3.

Ratios among various elements of the four-bar linkage 31*a*, 31*b*, 31*c* are selected based on the typology of desired movement of the arm 3. Preferably, the four-bar linkage has cranks 31*a*, 31*b* having mutually different length. Evidently, length means the greater dimension of cranks 31*a*, 31*b*. The connecting rod 31*c* has preferably a dimension smaller than cranks 31*a*, 31*b*.

According to another preferred aspect, the connecting rod 31*c*, or better the distance from the constraining points p1, p2 of the connecting rod 31*c*, is smaller than the distance between the constraining points of the cranks 31*a*, 31*b* on the base structure 2. In the shown preferred embodiment, another constraining element 7, preferably a couple of constraining elements, connects the first portion 31 to the second portion 32 of the arm 3. The constraining elements 7 allow, along with the movement means 6, reducing the degrees of freedom of the arm 3 to only one.

The constraining elements 7 are constrained to a general element of the four-bar linkage 31*a*, 31*b*, 31*c*. Preferably, as in the shown embodiment, the constraining elements 7 are constrained to the crank 31*b*. The constraining elements are rigid and subjected to tensile stress when the arm is folded, and they are stressed under compression when the arm 3 is extended. In a preferred embodiment the elements 7 can be adjusted in height; in this way, possible size errors of the arm components can be balanced, in particular in the four-bar linkage.

Figure 10:
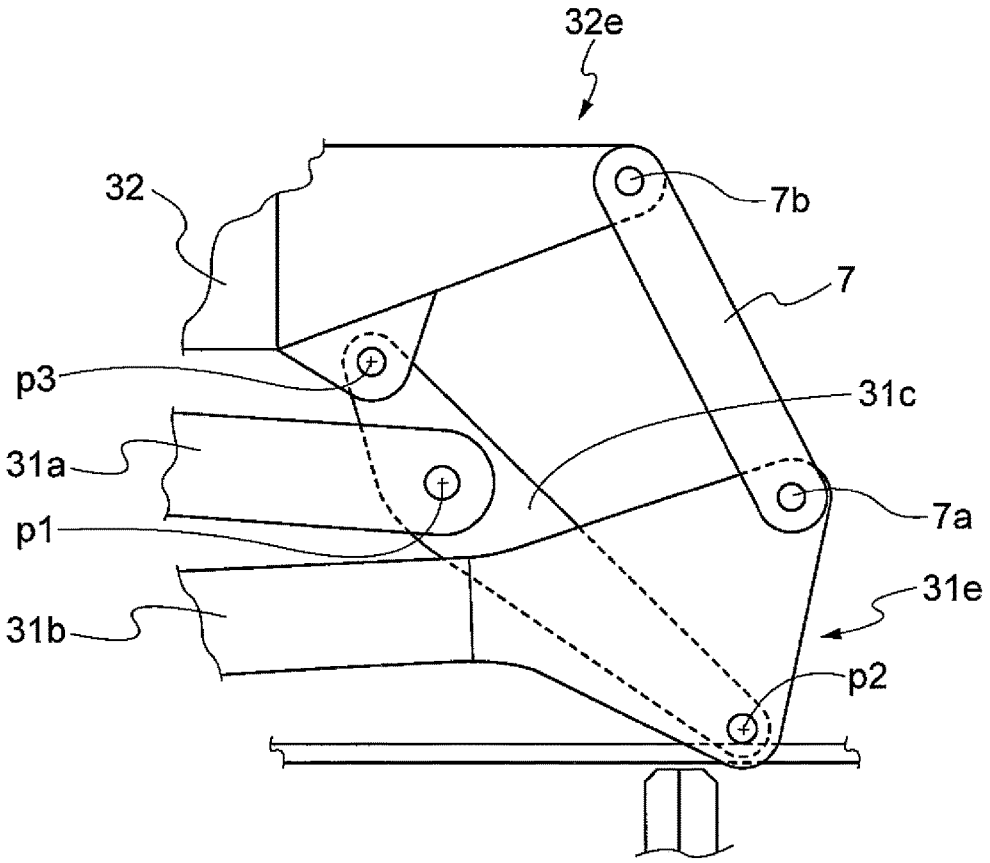
FIG. 10 is a magnified view of the detail X of FIG. 2.

According to a preferred aspect of the present invention, the constraining elements 7 form a second linkage of four bars, i.e. a second kinematic system of four elements mutually articulated, which can be seen in detail referring to FIG. 10. The sides of such a kinematic system comprise a constraining element 7, the connecting rod 31*c*, the crank 31*b* of the four-bar linkage to which the constraining element 7 is connected, and the second portion of the arm 32. Only a portion of the crank 31*b* and the arm 32 are part of the second kinematic system. In particular, the end 32*e* of the second portion 32, opposite to the end of the portion 32 constraining to the rotating structure 4, is part of the kinematic system with the end 31*e* of the crank 31*b* opposite to the end of the crank 32 constrained to the base structure 2.

More in detail, the second kinematic system is defined by four distinct vertices p2, p3, 7*a*, 7*b*. As mentioned, p2 is the hinge point between the crank 31*b* and the connecting rod 31*c*. p3 is the hinge point between the connecting rod 31*c* and the second portion 32 of the arm 3. 7*a* is the hinge point between the constraining element 7 and the crank 31*b*. 7*b* is the hinge point between the constraining element and the second portion 32 of the arm 3.

Figure 5:
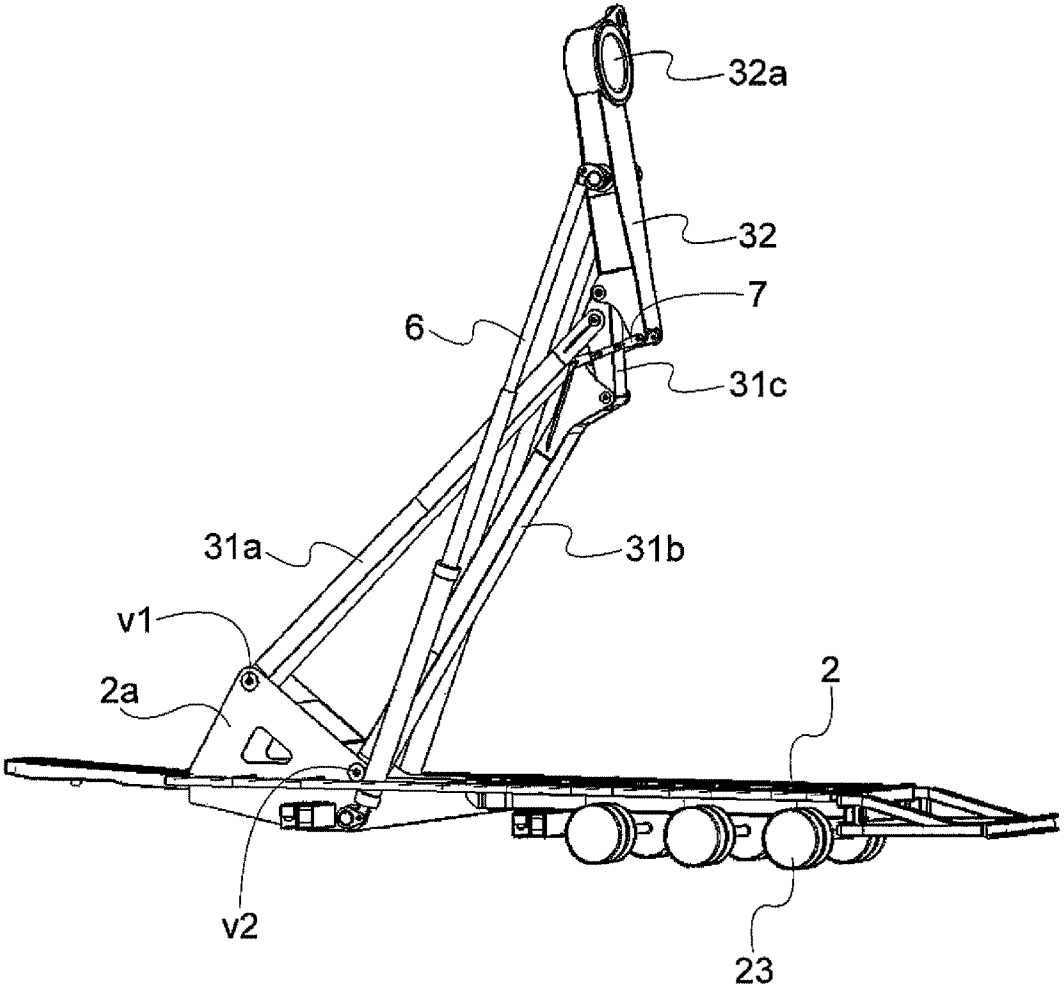

According to an aspect of the present invention, during the relative movement between the portions 31, 32 of the arm 3, two side of the second linkage of four bars (or second kinematic system) cross each other so that to be incident, as visible for example in FIG. 5. These two sides correspond to the connecting rod 31*c* and the constraining means 7.

In particular, in the present embodiment there are a couple of rigid tension rods 7 parallel and hinged along the same hinge axes. In other terms, the tension rods 7 both rotate with respect to the first portion 31 of the arm 3 around the same rotation axis, by two different and aligned hinges. A similar constraint is made by the tension rods 7 and the second portion 32 of the arm 31.

In general, a single tension rod 7 can be used in place of the couple of tension rods 7, provided that its movement does not interfere with that of the connecting rod 31*c*.

Analogously, it has to be outlined that each element of the four-bar linkage 31*a*, 31*b*, 31*c* (and actually each element of the arm 3 comprising, for example, the second portion 32), for example the cranks 31*a*, 31*b*, the connecting rod 31*c*, can be replaced by a couple of hinged elements through mutually aligned hinges, similarly to the couple of tension rods 7.

The second portion 32, as mentioned, is preferably constituted by a unique element, or any way by a series of mutually integrally constrained elements. Preferably, the second portion 32 has a length, i.e. its own main dimension, smaller than the length of the cranks 31*a*, 31*b*. The second portion 32 of the arm 3 further has a bush 32*a* allowing the constraint of the rotating structure 4 with the arm 3.

The amusement device 1 is further provided with movement means 6 for moving the arm 3. Suitable movement means 6 are known in the art. In the shown embodiment, the movement means comprise a couple of hydraulic pistons 6 hinged between the arm 3 and the base structure 2. Preferably, the movement means 6 are constrained to the portion 32 of the arm constrained to the rotating structure 4.

In alternative embodiments, not shown, the movement means 6 can be constrained to the portion 31 of the arm.

As better explained in the following, the activation of the hydraulic pistons 6 causes the relative rotation between the two portions 31, 32 of the arm 3, consequently the arm 3 extends and raises up. In the present invention a different number of pistons, or jacks, or in general a different movement means for moving the arm 3, cab be used.

The rotating structure 4 rotatably constrains to the arm 3, for example by a pin that can be rotatably fitted in the bush 32*a*. At least one vehicle 8 is constrained to the rotating structure in order to house, in a known way, one or more passengers, and generally a plurality of vehicles 8 arranged in a substantially equidistant way from the rotation axis R, i.e. substantially along a circumference having the axis R as its own center. In a known way, the vehicle (vehicles) 8 is/are constrained swingingly with respect to the rotating structure 4 so that, due to the centrifugal force acting onto the vehicles 8 during the rotation of the rotating structure 4, the vehicles place themselves radially with respect to the rotation axis R.

In general, rotating structures of the known art can be used in an amusement device according to the present invention. However, according to an aspect of the present invention, a rotating structure 4 having concave section is preferably used, such as that one shown in figures. Structure section means a section arranged along a plane on which the rotation axis R lies.

In particular, referring to FIG. 1, the section of the rotating structure 4 has a central portion 4*a* arranged next to the rotation axis R, and an outer portion concentric to the central portion 4*a* and tilted with respect to the central portion 4*a* of an angle smaller than 180°. The central portion is preferably arranged radially with respect to the rotation axis R, i.e. it is substantially perpendicular to the rotation axis R.

According to an alternative implementation, not shown, the rotating structure 4 has a concave and curved section, whereby a central portion and an outer portion can not be distinguished. These conformations allow the perimeter of the rotating structure 4, i.e. the portion of the rotating structure being at the maximum distance from the rotation axis R, to be moved closer to the ground 5 when the rotating structure 4 is arranged in its own position in which passengers are loaded, shown in FIG. 6.

Preferably the vehicles 8 are arranged at the perimeter of the rotating structure 4. In particular, according to an aspect of the present invention, these vehicles 8 are arranged substantially flush with the base structure 2, when the rotating structure 4 is in its own passenger load position.

Figure 3:
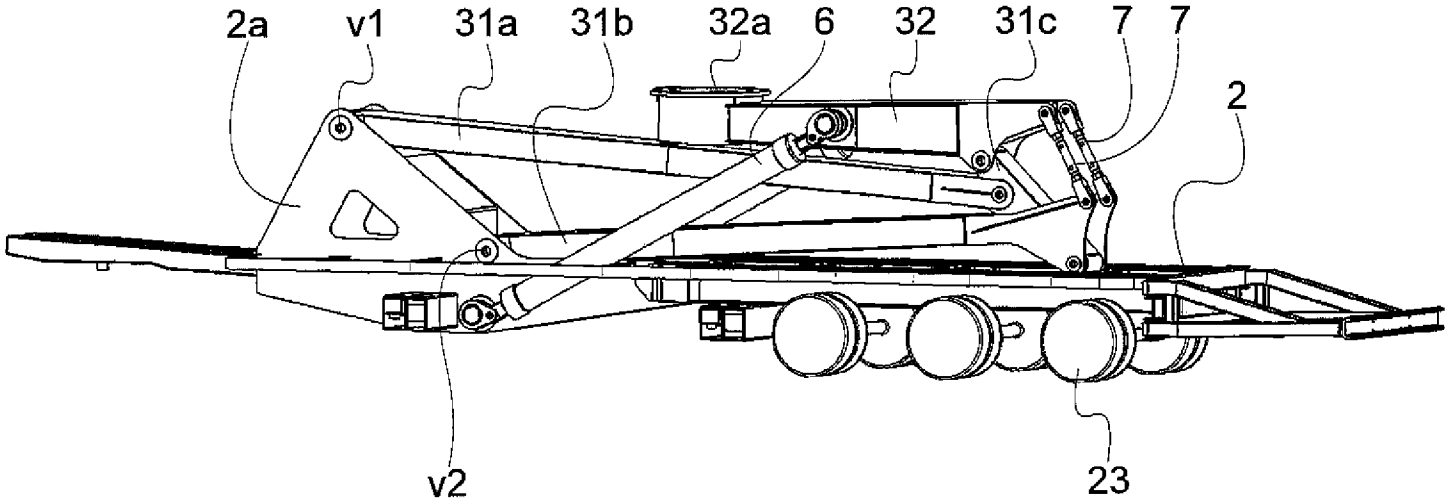
FIGS. 3-5 are perspective views of the operation of the arm of an amusement device according to the present invention, in which the rotating structure is omitted.
Figure 6:
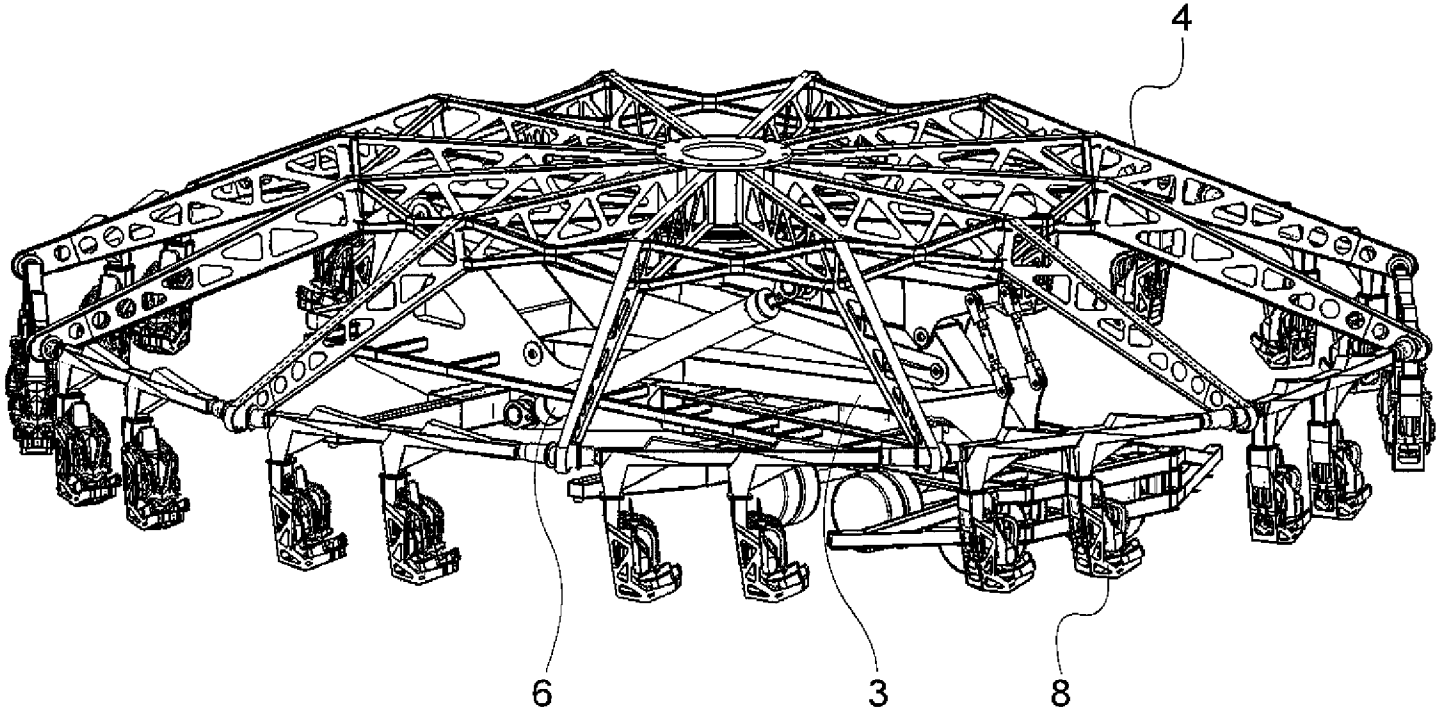
FIGS. 6-8 are perspective views of the operation of the arm of an amusement device according to the present invention, similar to views 3*a*-3*c*, in which the rotating structure is shown.

During use, the amusement device 1 has at first the rotating structure 4 in the position in which passengers are loaded; such a position is illustrated in FIGS. 2 and 6. The corresponding position of the arm 3 is shown in FIG. 3. In this position the arm 3, and preferably also the base structure 2, is completely comprised in the cylinder C whose axis is the rotation axis R, and whose radius is the distance between the vehicle 8 and the rotation axis R.

Typically, in such a position, the rotation axis R is substantially perpendicular to the ground 5. In this position, vehicles are preferably flush with the base structure 2, and passengers can get in all vehicles 8, in case also directly from the ground 5.

In this condition the rotating structure is usually stopped. The centrifugal force acting onto the vehicles 8 is then substantially null, whereby the vehicles 8 are arranged substantially parallel to the rotation axis R.

Particularly referring to the present embodiment and to FIG. 3, in such a condition the portions 31, 32 of the arm are arranged substantially parallel one another.

Then, when passengers have been loaded on the vehicles 8, the movement means 6 are driven to mutually space out and/or rotate the portions 31, 32 of the arm 3.

Because of the constraints between the portions 31, 32 of the arm 3 and between the arm 3 and the base structure, such a movement of the arm causes the rotating structure 4 to raise up.

In particular, according to the embodiment shown in figures, in the first steps of activation of the movement means 6, due to the ratio between the dimensions of the various elements of the portions 31, 32 of the arm 3, the rotation of the first portion 31 with respect to the base portion 2, and the relative rotation between the arms 31, 32, happen along opposite ways and have similar angles.

More in detail, in the first steps of the raising of the arm 3, the connecting rod 31*c* is rotated of an angle noticeably smaller than the cranks 31*a*, 31*b*. Furthermore, the angle the movement means 6 sweep is similar to the rotation angle of the cranks 31*a*, 31*b*. Thanks also to the presence of the tension rods 7, or similar connecting means, the rotation angle of the second portion 32 of the arm 3 is little.

At first, the rotating structure 4 is then raised with respect to the ground 5 with a little (or null) variation of its own tilt (i.e. of the tilt of the rotation axis R) with respect to the ground 5.

Figure 4:
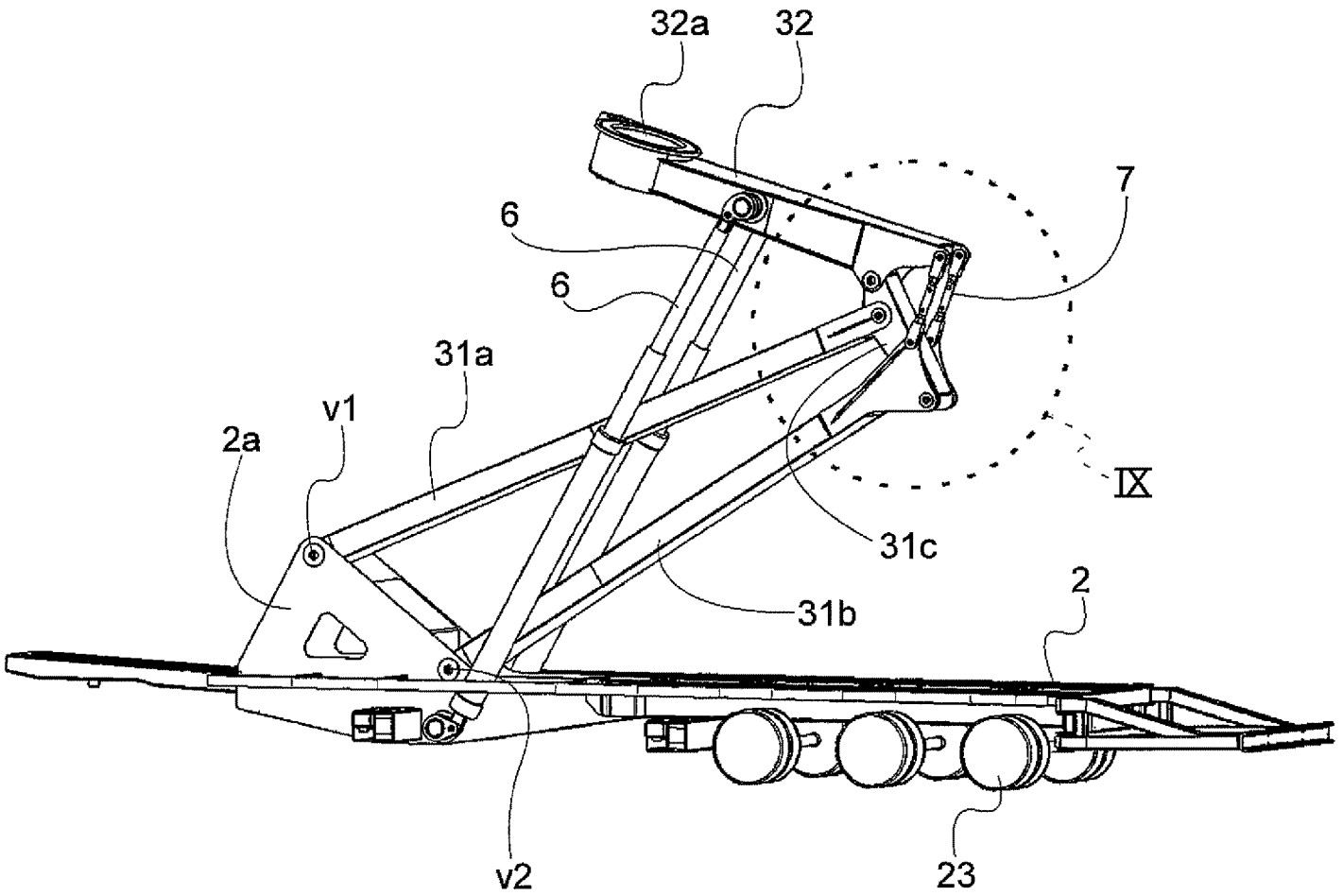
Figure 7:
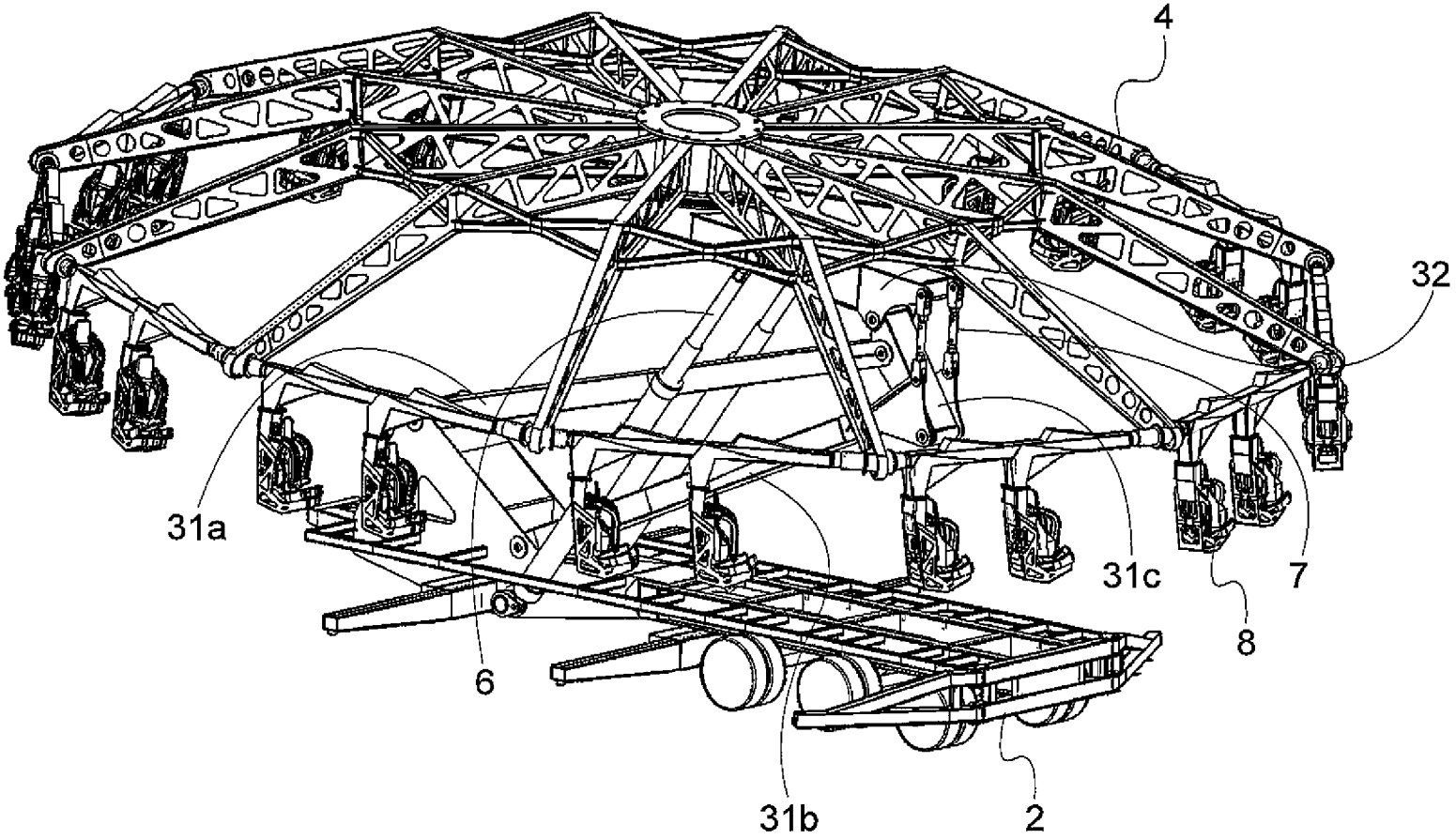

Such a condition is illustrated in FIGS. 4 and 7. In the meanwhile, the rotating structure 4 increases its own rotation speed, and the vehicles 8 tend to arrange radially with respect to the rotation axis R.

When the activation of the movement means 6 is at the end, the rotating structure 4 is rotated appreciably with respect to the ground, preferably so that its own rotation axis R has a great angle, preferably near to 90 degrees.

In particular, in the shown embodiment, when the activation of the movement means 6 is at the end, the relative rotation between the portions 31, 32 of the arm 3 is greater than the rotation (clockwise) of the portion 31 with respect to the fixed structure, whereby the rotating structure 4 changes noticeably its own tilt with respect to the ground.

More in detail, in this step the connecting rod 31*c* of the four-bar linkage is rotated by a great angle. On the contrary, referring to the second four-bar linkage or second kinematic system, the connecting rod 31*c* crosses the tension rods 7, causing the second portion 32 of the arm 3, and then the rotating structure 4, to both rotate.

Such a condition is illustrated more in detail in FIGS. 5 and 8.

When the arm 3 closed, i.e. when it passes from the rotation position shown in FIG. 8 to the load position shown in FIG. 6, the afore described process is carried out backwards.

The invention claimed is:

1. Amusement device comprising a base structure, an arm constrained at least rotationally to said base structure, a rotating structure provided with at least one vehicle and rotatably constrained with respect to one end of said arm, around a rotation axis, movement means for moving said arm between at least a first load position in which passengers are loaded, and a second rotation position of said rotating structure, characterized in that said arm comprises at least two portions mutually movable, said first portion of said arm being rotationally constrained to said base structure, said second portion of said arm being constrained to said rotating structure, wherein, in said load position, said arm portions are completely comprised in a cylinder having an axis that is said rotation axis, and having a radius that is the distance from said at least one vehicle to said rotation axis, and wherein said movement means are constrained to the second portion of said arm, said arm is constrained to said rotating structure.

2. The amusement device according to claim 1 wherein, in said load position, said base structure is completely comprised in said cylinder.

3. The amusement device according to claim 2, wherein said at least two portions of said arm are mutually rotatable.

4. The amusement device according to claim 3, wherein at least one portion of said arm comprises at least one four-bar linkage.

5. The amusement device according to claim 4, wherein said four-bar linkage comprises two cranks hinged to said base structure, and a connecting rod hinged in three different points, respectively to said first crank, said second crank and a second portion of said arm and further comprising at least one constraining element, which is not part of the four-bar linkage and connects said second portion to an end of one of said cranks.

6. The amusement device according to claim 1, wherein said at least two portions of said arm are mutually rotatable.

7. The amusement device according to claim 1, wherein at least one portion of said arm comprises at least one four-bar linkage.

8. The amusement device according to claim 7, wherein said four-bar linkage comprises two cranks hinged to said base structure, and a connecting rod hinged in three different points, respectively to said first crank, said second crank and a second portion of said arm.

9. The amusement device according to claim 8, further comprising at least one constraining element, which is not part of the four-bar linkage and connects said second portion to an end of one of said cranks.

10. The amusement device according to claim 8, wherein a side of said four-bar linkage is constituted by a constraining portion integral with the base structure, said constraining portion comprising two constraining points where said cranks are pivoted, said constraining points being placed at different heights from the ground.

11. The amusement device according to claim 1, wherein said arm has two mutually movable portions.

12. The amusement device according to claim 1, wherein said rotating structure has a concave section.

13. The amusement device according to claim 1, wherein, in said load position, at least one constraint is placed substantially flush with said base structure.

* * * * *